US009458640B2

(12) United States Patent
Small

(10) Patent No.: US 9,458,640 B2
(45) Date of Patent: Oct. 4, 2016

(54) METHODS AND APPARATUS FOR FORCE MANAGEMENT IN FALL PROTECTION APPARATUS

(71) Applicant: HIGH ENGINEERING CORP., Calgary (CA)

(72) Inventor: Greg Small, Calgary (CA)

(73) Assignee: High Engineering Corp., Calgary (CA)

( * ) Notice: Subject to any disclaimer, the term of this patent is extended or adjusted under 35 U.S.C. 154(b) by 0 days.

(21) Appl. No.: 14/078,267

(22) Filed: Nov. 12, 2013

(65) Prior Publication Data

US 2014/0346312 A1 Nov. 27, 2014

Related U.S. Application Data

(60) Provisional application No. 61/724,610, filed on Nov. 9, 2012.

(51) Int. Cl.

| | |
|---|---|
| ***F16M 13/00*** | (2006.01) |
| ***E04G 21/32*** | (2006.01) |
| ***A62B 35/00*** | (2006.01) |
| ***A62B 35/04*** | (2006.01) |

(52) U.S. Cl.

CPC ..... *E04G 21/329* (2013.01); *A62B 35/0068* (2013.01); *A62B 35/04* (2013.01); *E04G 21/3295* (2013.01); *A62B 35/0056* (2013.01); *Y10T 29/4973* (2015.01)

(58) Field of Classification Search

CPC ..... A62B 35/04; A62B 35/00; A62B 1/04; A62B 35/0068; A62B 35/0056; E04G 21/329; E04G 21/3295; Y10T 29/4973

See application file for complete search history.

(56) References Cited

U.S. PATENT DOCUMENTS

| | | | | |
|---|---|---|---|---|
| 3,217,833 | A * | 11/1965 | Smith | 182/3 |
| 4,607,724 | A * | 8/1986 | Hillberg | 182/3 |
| 4,905,606 | A * | 3/1990 | Tupper | 104/113 |
| 5,088,726 | A | 2/1992 | Lapcevie | |

(Continued)

FOREIGN PATENT DOCUMENTS

| | | |
|---|---|---|
| CA | 2105950 | 3/1993 |
| GB | 2351789 A | 1/2001 |
| WO | WO03047700 A1 | 6/2003 |

OTHER PUBLICATIONS

SpiraTech Force Management Technology, www.unilinesafety.com, Copyright 2012.

(Continued)

*Primary Examiner* — Amy Sterling
(74) *Attorney, Agent, or Firm* — Parlee McLaws LLP (CGY); Sean W Goodwin

(57) ABSTRACT

Methods of force management for a force management anchor (FMA) include apparatus between a post and a base plate that resist post rotation under fall loads, the apparatus resisting said rotation at a constant torque. A peak constant torque is less than a torsional "tear-out" capacity of a surface for maximizing energy absorption. While the fall force vector remains generally parallel to the base plate during a fall, the post is movable between an upstanding and a lowered orientation resulting in a variable moment arm and a resisting force that also varies for maintaining the torque substantially constant. Apparatus can include devices between the post and the base plate such as a torsion rod, a friction clutch or a cam arrangement. Other approached include designed deformation of the post itself, such as a through tapered post.

11 Claims, 15 Drawing Sheets

(56) References Cited

U.S. PATENT DOCUMENTS

| | | | | |
|---|---|---|---|---|
| 6,173,809 | B1 | 1/2001 | Cole et al. | |
| 6,478,111 | B2 * | 11/2002 | Olson et al. | 182/3 |
| 6,688,062 | B2 * | 2/2004 | Choate | 52/414 |
| 7,163,083 | B2 * | 1/2007 | Argoud | 182/113 |
| 7,207,414 | B2 | 4/2007 | Luke et al. | |
| 2009/0200109 | A1 | 8/2009 | Luke | |

OTHER PUBLICATIONS

Miller Fusion Roof Anchor Post adapts to a variety of roof structures, www.millerfallprotection.com.

* cited by examiner

METHODS AND APPARATUS FOR FORCE MANAGEMENT IN FALL PROTECTION APPARATUS

CROSS-RELATED APPLICATIONS

This application claims the benefits under 35 U.S.C 119(e) of the U.S. Provisional Application Ser. No. 61/724,610, filed Nov. 9, 2012, the subject matter of which is incorporated fully herein by reference.

FIELD

Embodiments disclosed herein generally relate to fall protection apparatus and in particular to a force management apparatus of the type used to anchor a person to a support structure and for controlling a descent of the person in the event of a fall from the support structure.

BACKGROUND

Many work situations require workers to be positioned on top of platforms or vehicles that cannot be practically protected by a guardrail system enclosing the work area. To minimize the risk of a fall from such elevated positions and should there be a fall, to minimize serious or mortal injuries, various fall protection systems can be used. In general, fall arrest or travel restraint systems are designed to prevent the worker from reaching an unprotected edge or, in the event off a fall, to manage the distance and deceleration before the worker impacts a lower level. While an energy-absorbing device, is usually incorporated between a worker's safety harness and their anchorage system, many anchorage systems include some energy absorption.

Such systems typically include a roof anchorage or spaced anchorages including a horizontal lifeline extending between anchorages secured to a surface structure, such as a roof of a building; the safety harness worn by the worker; and a flexible tether line or "lanyard" interconnecting the anchorage or horizontal lifeline to the harness. The roof anchorage apparatus in the subject application is typically referred to in the fall arrest industry as a "tip over post" or a "force management anchor" (FMA).

In the event of a fall, the forces associated with the fall are generally parallel to the surface of the support structure and typically perpendicular to the FMA, extending generally parallel to the surface of the support structure and then over an edge thereof, or from a horizontal lifeline connected between two or more anchors, pressed into service due to the fall. Fall arrest loading includes a user directly connected to the FMA or connected to a horizontal lifeline (HLL) spanning between spaced FMAs. When subjected to a large force, such as when arresting a fall, the FMA typically rotates until the tip of the post nears the base plate and the forces are adjacent and nearly parallel to the base.

One useful purpose of a FMA is to absorb energy from a horizontal force while protecting the integrity of a generally weak roof envelope/membrane. The perpendicular force imparted into the post imparts a tipping moment into the post and likewise into the base. Fasteners, located on the base plate at an opposing side from whence the force is imposed, are placed to optimize a pull-out or tear-out resistance. Many surfaces, such as wood or sheet metal, have a limited and finite capacity to resist a moment or pull-out load imparted thereto but do have a much greater capacity to resist parallel shear forces in-line with the roof membrane.

Thus, typically a conventional FMA's repositions the leverage of the force from a maximum moment to a minimum moment adjacent the base plate so as to take advantage of the much greater strength along a plane of the roof inline more so with the base. However, Applicant has noted that FMA's appear to predominantly consider the initial moment exerted on the post, and thus upon the roof structure, at the point of release when the post leaves an orientation substantially perpendicular to the surface. The design load, post and base plate apparatus is such that the base plate and roof are capable of withstanding the initial loading at a maximal moment arm and maximal torque.

However, in some cases once a conventional FMA begins to tip, very little energy is absorbed as the FMA rotates towards the base, from a maximum moment to its minimum moment. Accordingly, the worker remains substantially in a period of free fall before the post reaches its minimum moment and least energy absorption, leaving additional fall energy that must be transferred to the remainder of the fall arresting system. Thus, and if the capacity of the system is exceeded, then the additional energy is transferred into the roof and the worker's body, which may lead to failure of the anchorage of the system and/or injuries to the worker.

Other FMA designs do include varying degrees of energy absorption, varying from negligible to some devices that deploy at a fairly constant force. In all cases, the total fall distance of the worker using FMAs is always greater than would occur if the anchorage was absolutely rigid.

Applicant believes that it is not physically possible to design an FMA that will reduce the total fall distance over that provided by an absolutely rigid anchorage. Absolutely rigid anchorages are frequently difficult to achieve without great expenditure and thus the sole purpose of such FMAs is to protect a weak anchorage.

For example, the SpiraTech™ "RoofSafe® Roof Anchor" available from Uniline Safety Systems Limited include a coiled tensile member encapsulated in a shell that breaks open once a tensile force is applied and deploys the tension member which unravels, thus initially absorbing some energy transferred to the hold-down fasteners on the roof from the falling worker.

In another example, the Miller "Fusion™ Roof Anchor Post" from Honeywell includes a built in energy absorbing component enclosed within a cylindrical shell. The energy absorbing component (tensile member) extends within the shell as the cylinder tips over when a horizontal force is applied, thus absorbing some of the energy.

The above examples absorb energy primarily down the axis of the tensile member or HLL because the initial force initiates the re-orientation of the force from large lever or moment arm when the FMA is perpendicular, to a small lever or short moment arm for the tensile force when it comes more in line with the post base. The energy associated with a falling worker can potentially injure the worker and potentially cause a failure in the connection between the FMA and the roofing membrane if they exceed the capacity of the fall arresting system.

Thus, it is Applicant's position that FMAs currently on the market have focused on protecting a generally weak anchorage or protecting a cladding layer of roof structure from the overturning torque or moment that may be applied by the FMA. The main intent to date has been to create an anchorage that stands above the roof surface to elevate the connection point of the user, but when a fall arrest loading is applied the purpose of the design has been to promptly lay the post down so that the forces are imparted into the roof structure primarily as a direct shear as close as possible to an outer cladding layer. The cladding layer has relatively low strength to resist a substantial overturning torque, but has considerable strength through membrane action to resist a shear applied along its surface. Therefore, a first consideration has been to reposition the forces closer to the anchorage. Conventional FMA's are mainly concerned with the torque that initiates tipping of the post and thereafter allow the post to rotate to a stronger position close to the base plate or roof surface, taking advantage of the much greater strength of putting the horizontal forces into the horizontal plane of the roof. However, many conventional FMA's provide little resistance after initial tip over and are substantially freely rotating or freely spooling throughout the rotation until the sudden arrest of the worker when the post parallels the roof line. Also, the conventional FMA's do not optimize the opportunity for energy absorption within the FMA itself.

Secondly, an important consideration in arresting the fall of a worker is that it is desirable for most the energy generated by the fall to be absorbed by the fall arresting system. When FMA deploys, as a function of absorbing energy it will actually allow the worker to fall somewhat further. However, when some quantity of energy is absorbed by the FMA, the worker will not accelerate as quickly or as much during the deployment of the FMA. Physics dictates that it is impossible to begin decelerating a worker connected to a horizontal lifeline at the instant that the horizontal lifeline begins to sag because the lifeline must first deflect until a tension in the worker's lanyard equals the weight of the worker (to counter the pull from gravity). Beyond this sag, known as the deceleration onset sag, the arresting force becomes greater than the worker's weight and the worker begins to slow down.

The remaining fall energy, at the stage where the FMAs have fully deployed, must be dissipated by other elements of the fall arrest system, such as additional stretch of the HLL, which will greatly increase the forces, but mostly by the deployment of a personal energy absorber that the worker has located between his harness and the HLL. This excess energy requires increased deployment of the personal energy absorber, and always increases the total fall distance of the worker and therefore increases the probability that the worker may strike the ground or a lower surface. There are instances with some of the existing FMA designs, where the increased energies gained by the worker due to their deployment of inefficient FMAs have exceeded the capacity of other energy absorbing mechanisms designed into the system, resulting in injurious impacts to the worker and damage to the roof the FMA is attached, to, possibly leading to complete failure of the anchorages.

Thus, the more energy that a FMA absorbs as it deploys, the sooner the fall energy of the worker is dissipated, the shorter the total fall distance of the worker, and the lower the probability of striking a lower surface and the lower the probability that larger impact forces may develop that may injure the worker or threaten the integrity of the anchorage of the system.

There is, therefore, a need in the art for an FMA having improved energy absorption when resisting a horizontal force while maintaining the integrity of a weak roof envelope/membrane, which only has a limited and finite capacity to resist pull out moments and a much greater capacity to resist horizontal forces once in line with the roof membrane.

SUMMARY

Embodiments of a fall protection apparatus described herein include a force management apparatus or anchor (FMA) secured to a support surface, typically a roof of a building, and having a post extending upright therefrom. A single point tether or a horizontal lifeline (HLL) may be connected to the post, a fall resulting in a fall force vector applied to the post and extending generally laterally therefrom. The FMA is adapted to attach to the surface typical roofing including materials such as sheet metal, wood, and other surfaces known in building construction. Practically, the FMA must remain secured to the surface during a fall. While the fall force vector remains generally parallel to the base plate during a fall, the post is movable between an upstanding and a lowered orientation resulting in a variable moment arm. The transferred forces and resulting overturning moment on the base plate must remain below a tear-out threshold.

Embodiments herein demonstrate a constant torque FMA for maximizing energy absorption using a post of fixed length, the post rotating, yet resisting said rotation, at a constant torque that provides an increasing resistance to the horizontal force from a HLL as the post rotates. A threshold or peak constant torque is selected to be that about of less than the torsional "tear-out" capacity of a roof surface with an allowance for an appropriate safety factor. The provided embodiments of the constant torque FMA absorb greater energies for the same total horizontal deployment than can be absorbed by a FMA that deploys with any other relationship between horizontal force vs. deployment that does not exceed the torque capacity of the roof to which the FMA is secured.

In embodiments herein, the FMA achieves in the order of about five times more energy absorption with the disclosed embodiments than some conventional FMA's that do not absorb energy at a constant deployment force and about 40% greater than the current art of absorbing energy at a constant deployment force.

The FMA utilizes a method of force management, having apparatus between the connection of the tether and the base plate for providing a substantially constant resistive moment or torque against the movement of the tether end of the anchor post. Maintaining a substantially constant resistive torque absorbs a maximum amount of energy, controlling the descent of the falling person, before the post rotates to its angular limit and arrest further movement. For an upstanding post, the moment arm is at its greatest and the potential torque at its greatest highest when the force is perpendicular to the post, typically when the post is upright on a horizontal surface. Thus, initial application of the fall force vector can potentially result in an initial and excessive resistive torque that overwhelms the base's, and mounting surface's, ability to resist connective tear-out failure therebetween. However, using a FMA fit with embodiments of the constant torque apparatus, the loading on the roof is maintained at about a peak loading at or below the threshold failure, preferably incorporating a safety factor, but being at a sustained and generally constant torque for maximum energy absorption, further absorbing the energy generated by a falling worker in the shortest possible distance.

In various embodiments, the methodology of applying a constant torque can be achieved using various apparatus including discrete apparatus arranged between the post and the base, incorporated into the post itself or combinations thereof.

In one broad aspect, a method is provided for managing forces of a fall using a fall management anchor anchored to a surface, the method comprising directing a fall force vector into a distal end of an upstanding post secured at a proximal end to a base plate anchored to the surface, the fall force vector being oriented generally parallel to the base plate; applying a substantially constant resisting torque to the post for absorbing energy as a distal end of the post rotates in response to the fall force vector and a moment arm of the post varies from an initial upright position towards a tipped position; and transferring the constant resisting torque into the base plate, the resulting moment at the base plate being at or less than a threshold tear-off torque.

In various embodiments the applying a substantially constant resisting torque comprises resisting rotation of the post at a friction clutch between the proximal end of the post and the base plate, or affixing a proximal end of the post to the base plate and resisting rotation of the distal end through successive yielding of an ever increasing cross-section of the post from a small cross-section at the distal end to a larger cross-section at the proximal end, or resisting rotation of the distal end of the post through a twisting of a torsion rod oriented substantially transverse to the fall force vector, or pivoting the proximal end of the post at the base plate; securing a constant force energy absorber to the base plate and extending a cable between the constant force energy and the post; and directing the cable over a cam rotatable with the post for maintaining the constant resisting torque on the post.

In another aspect, a fall management anchor is secured by a base plate to an surface, the base plate and surface having a threshold tear-off torque in response to fall force vector applied thereto, the anchor comprising a generally upstanding cantilever post having a proximal end connected to the base plate and having a distal end, the fall force vector oriented generally parallel to the base plate, the distal end actuable between maximum moment arm and diminishing to a minimum moment arm in response to the fall force vector; and a constant torque apparatus operative between the distal end and the base plate for applying an increasing resistive force to the post as the post's moment arm diminishes from the maximum to the minimum, the constant torque apparatus producing a generally constant torque at the base plate that is less than or equal to the threshold tear-off torque.

DESCRIPTION

Figure 1B:
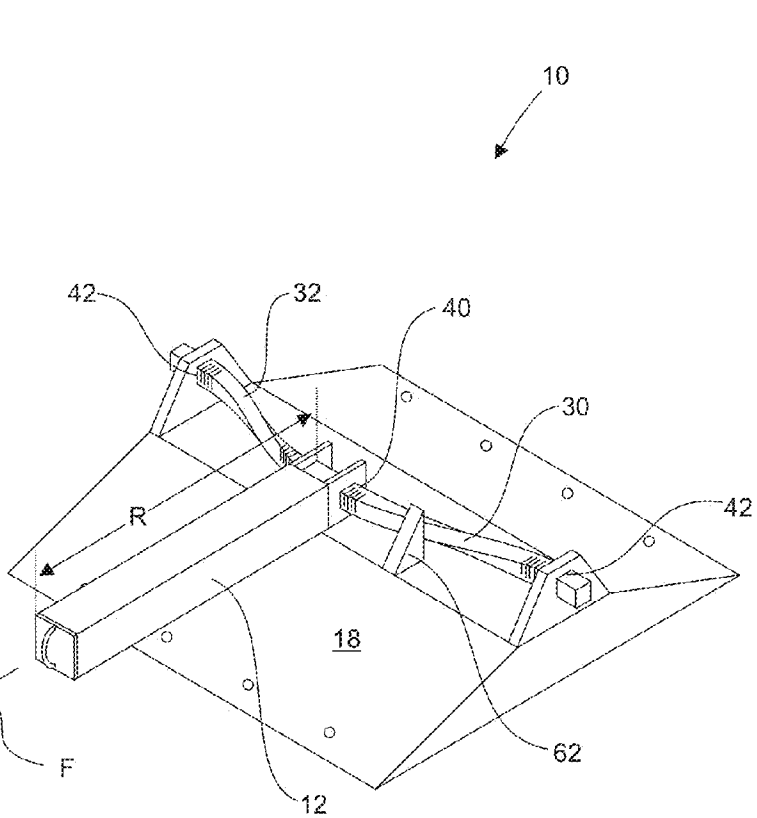
FIG. 1B is a perspective view of the FMA of FIG. 1A illustrating the post having been tipped by a horizontal force vector and illustrating a twisted torsion rod.
Figure 1A:
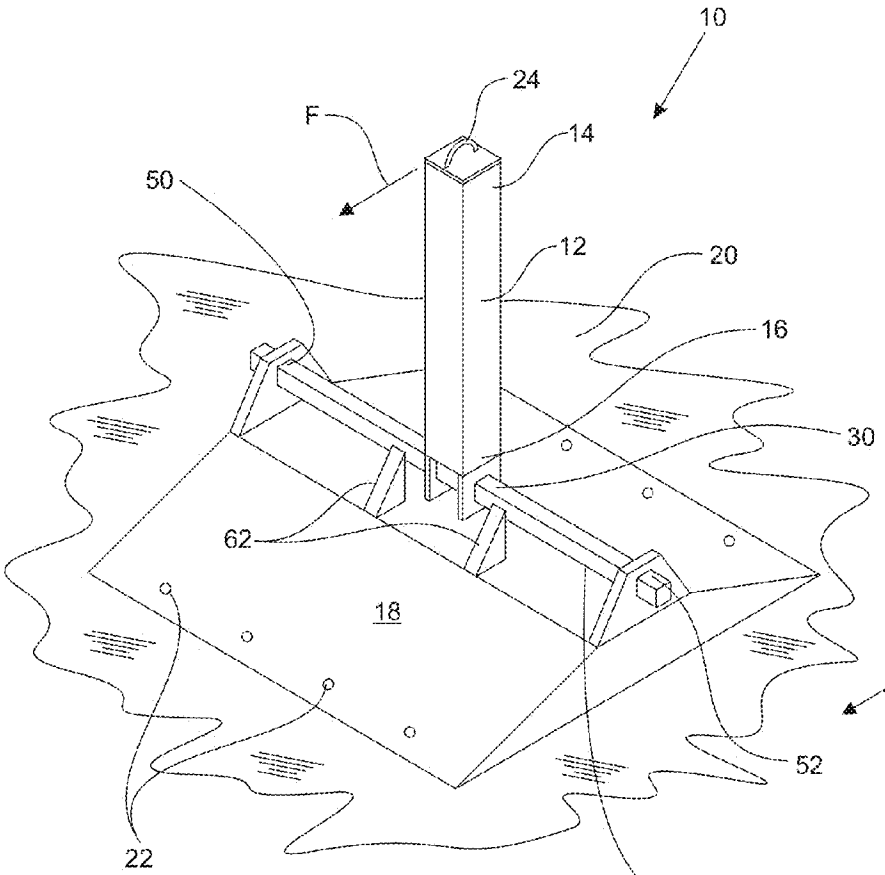
FIG. 1A is a perspective view of an embodiment of a constant torque Force Management Apparatus or FMA utilizing a torsion rod.

With reference to FIG. 1A, Force Management Apparatus (FMA) 10 is disclosed herein generally comprising an upstanding post 12 having a top, distal end 14 and a bottom, proximal end 16 that is connected to a base plate 18. The base plate 18 is adapted for securing to an anchorage or a support surface 20 such as a roof, or any surface the base plate 18 may be mounted thereon, and includes connection means such as fasteners 22 or the like. The base plate 18 may either be rigid or capable of yielding when a force is applied thereon. Typically the base plate 18 is mounted to a horizontal surface 20, however one understands that some surfaces, particularly roofs are not always horizontal.

Figure 14A:
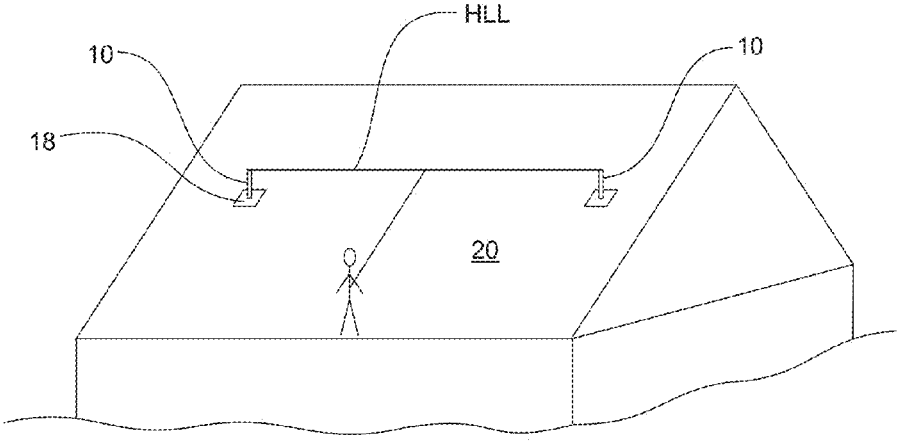
FIGS. 14A and 14B illustrate the arrangement of a horizontal lifeline between two FMAs, before and after a fall event.

Also, one or more FMAs 10 can be used to mount anchors and horizontal lifelines HLL on roofs (FIGS. 14A and 14B) and on the face of a vertical surface or wall (not shown). Herein, for convenience, the base plate is assumed to be arranged on the horizontal, and the imparted force on the post 12 is generally about parallel to the base plate 18, along a fall force vector.

In use, the distal end 14 of the post 12 moves in a generally rotating manner upon application of a lateral force, the post being displaced or rotating generally about the proximal end 16 from an upright position (FIG. 1A) to a substantially nearly prone position (FIG. 1B) or to a required angle that balances the applied horizontal force F from the tether or horizontal lifeline HLL. Fall loads are imposed at the distal end 14 of the post and extend generally parallel to the base plate 18. The fall loads extend along a fall force vector F initially starting about perpendicular to the post 12 and ultimately approaching a near inline alignment as the post 12 rotates from the upright position to a position more or less parallel to the base plate 18.

Note that in instances where the base plate 18 is mounted to a horizontal surface 20, the upright post starts in a vertical position and rotates to a near horizontal position. The terms upright and vertical and, likewise, the terms horizontal and parallel to the base plate can be used interchangeably even through the surface may not strictly be horizontal, such as for a sloped roof surface, The distal end 14 of the post resists rotation through apparatus associated with the post or through the form of the post itself. The distal end has an attachment loop or hook 24 located thereon for attaching the tether or horizontal lifeline HLL through which the fall force vector F is applied.

In embodiments, such as those shown in FIGS. 1A to 8B, the proximal end 16 of the post 12 is attached to the base plate 18 through, or incorporates therein, a constant torque device 30. In other embodiments, such as those shown in FIGS. 9A-13D, the post 12 itself may incorporate properties or characteristics for imparting a constant resistive torque. Application of a constant resistive torque, active through a substantial portion of the rotation, provided for maximal energy absorption.

As described in embodiments set forth herein a constant torque FMA maximizes energy absorption using a post of fixed length, the post rotating, yet resisting said rotation, at a constant torque that provides an increasing resistance to the horizontal force from a HLL as the post rotates. A threshold or peak constant torque is selected to be that about of less than the torsional "tear-out" capacity of a roof surface with an allowance for an appropriate safety factor. The provided embodiments of the constant torque FMA absorb greater energies for the same total horizontal deployment than can be absorbed by a FMA that deploys with any other relationship between horizontal force vs. deployment that does not exceed the torsional capacity of the roof or anchorage generally. In the case of an anchorage surface being a roof of a building that is able to sustain a specified torque before base plate release such as upon fastener pull out, one wants the post to apply approximately the specific peak torque from about instant the post of the FMA starts to move to the point where the horizontal force on the tip of the anchor post is able to resist the tension from the horizontal lifeline cable. The post stops deflecting when the force from the HLL balances the resistance of the post, and the HLL and a personal energy absorber do their work to stop the fall. At very high forces, from the horizontal lifeline cable, the post will lay essentially horizontal, but at lower forces, it will stop rotating prior to becoming horizontal, reducing the amount of deployment and thus reducing the sag of the horizontal lifeline. This is the theoretically the most efficient way to absorb energy without exceeding the roof torque. The embodiments disclosed herein impart a substantially constant resistive torque throughout the range of motion of the moment arm of the post despite the decreasing moment arm as post rotates towards the base.

In a fall of a worker imposing forces F onto the post 12, a substantially constant torque is sustained throughout the angular range of motion of the post 12 while maintaining as near a peak torque on the surface as possible without failure of connection between the base plate 18 and surface 20. Typically a further safety factor is also provided, the peak torque being safely less than the pull-out or tear-out torque. When the peak torque of the over turning moment on the base plate exceeds a threshold tear-out moment, the connection fails. The forces of a fall are managed using the FMA 10 anchored to the surface 10 by directing the fall force vector F into the distal end 14 of the upstanding post 12. The fall force vector F is oriented generally parallel to the base plate 18. A substantially constant resisting torque is applied to the post 12 for absorbing energy as a distal end 14 rotates or otherwise displaced in response to the fall force vector F and as a moment arm of the post 12 varies to diminish from an initial upright position towards a tipped position. The constant resisting torque is transferred into the base plate 18, the resulting moment at the base plate being at or less than the threshold tear-off torque.

From a theoretical standpoint, the horizontal fall force vector F is unlikely to rotate the post 12 to lay completely horizontal as this would require a near infinite force, however, the mathematical difference between energy absorbed by a constant horizontal force and the energy absorbed by a constant torque, for the same force applied to rotate post 90 degrees can be developed as follows: F=the horizontal force applied at the distal end to cause the post to rotate; R=the Radius (height of the post)=the lever arm for the torque=the horizontal distance travelled as the post rotates from vertical to horizontal; A=the angle the post rotates through about $90°=\pi/2=1.57$ radians Energy Ucf absorbed for a constant horizontal force=$Ucf=F\times R$ Energy Uct absorbed for a constant torque=$Uct=F\times R\times A$ Thus the ratio of energy absorbed over a rotation of the distal end from about vertical to about horizontal=$Uct/Ucf=A=\pi/2=1.57$. While it is not theoretically possible to achieve quite this much absorption, as the horizontal force will never go to infinity, it is reasonable however for a horizontal lifeline HLL to manage forces close to 6,000 lb.

Most designs of FMAs contemplate a roof surface 20 can accept a pull-out/tear-out torque or moment of between 500 and 1000 ft-lb. Therefore, if a 12 inch long post starts to deploy at a horizontal force around 1000 lbs and stops when the horizontal force reaches 6,000 lbs, then, for a torque of FxR at a specified angle (A), the horizontal force will be $H=F/\cos(A)$ which goes to infinity as A approaches $90°=\pi/2$ and $\cos(A)=F/H$ or $A=a\cos(F/H)$.

Therefore, a reasonably achievable maximum angle should be about $A=a\cos(1000/6000)=80$ degrees or 1.40 radians. Therefore one should practically be able to achieve a 40% increase in energy absorbed by using the constant torque approach described herein. This is a significant gain over the best of the known constant force FMAs, and is orders of magnitude better than those prior art posts that simply flop over and absorb little energy.

Example #1

Torsion Rod

One embodiment of a force management anchor (FMA) fall protection apparatus comprises the upright post 12 pivotally connected to the base plate 18. The distal end 14 of the post 12 has an attachment loop 24 for connecting to the tether or horizontal lifeline HLL that imparts the fall force vector F, and the connection between the proximal end 16 and the base plate is fit with or otherwise incorporates the constant torque device 30.

In this embodiment the constant torque device 30 comprises a torsion rod and support structure. A torsion rod 32 is placed at the connection between the post 12 and the base plate 18. A substantially constant resisting torque is applied to the post 12 through a twisting of the torsion rod 32 that is oriented substantially transverse to the fall force vector F.

Figure 4:
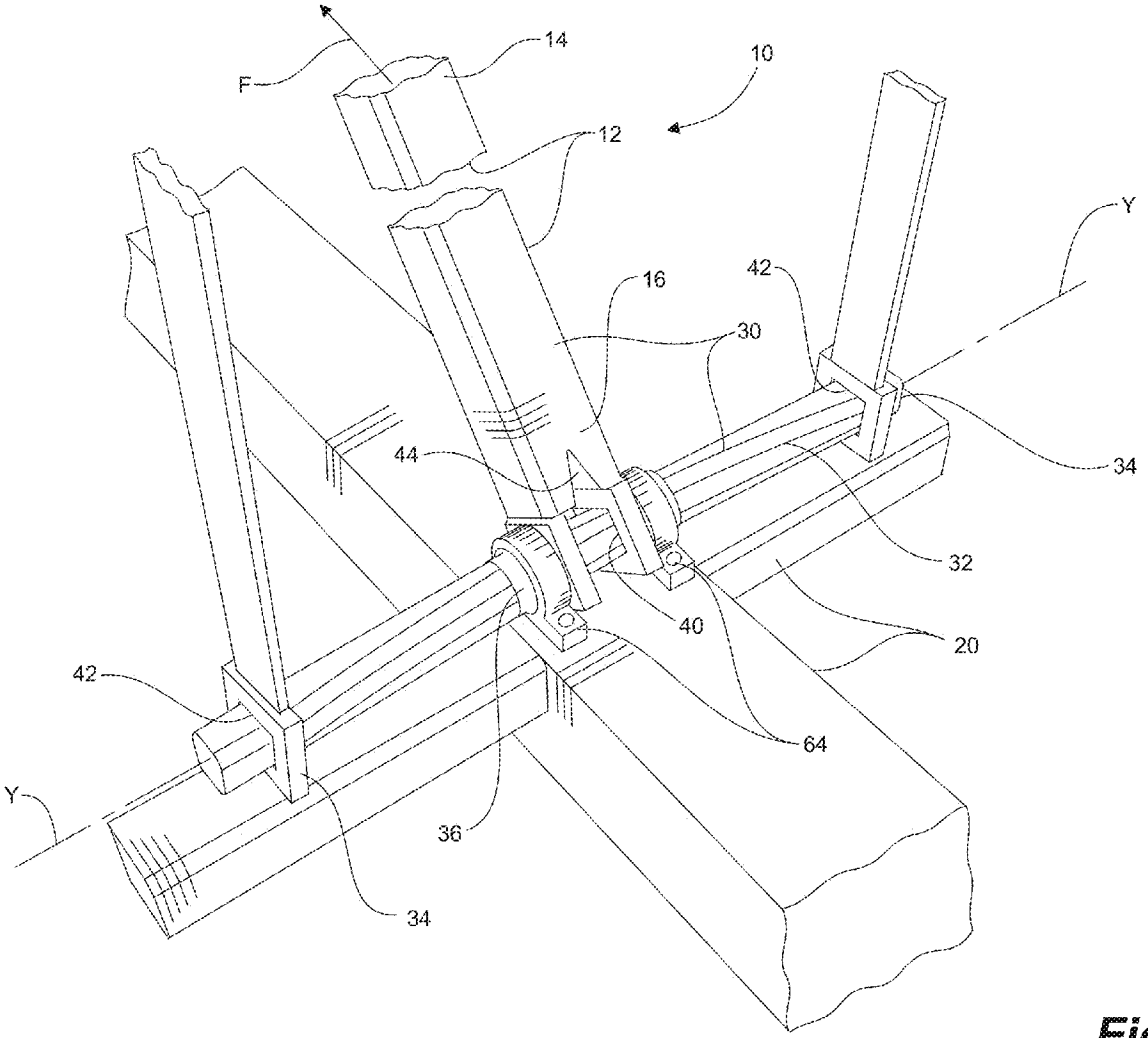
FIG. 4 is a perspective view of the embodiment of FIG. 1 showing the torsion rod having been plastically deformed.

Turning to FIGS. 1A, 1B and 4, the torsion rod 32 may be hollow or solid, and is rotationally constrained at opposing and spaced outboard ends 34, 34 to the base plate 18. The post 12 is also rotationally constrained to the torsion rod 32 at an intermediate location along the rod 32 between the outboard ends 34, 34. The torsion rod 32 has an axis Y which forces the rotation of the distal end 14 about this axis Y, defining the pivot point 36 or fulcrum. The rod 32 twists when the fall force vector F is applied to the distal end 14 of the post 12.

Figure 15A:
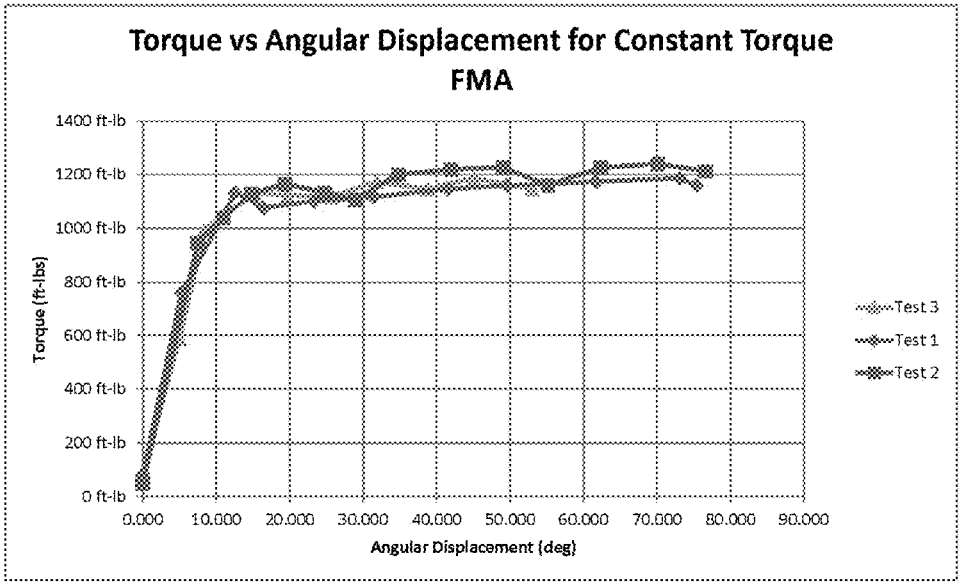
FIGS. 15A and 15B are graphs illustrating the substantially constant torque results from testing on the apparatus of FIG. 5, namely illustrating torque vs. angular displacement and force vs. displacement.

As shown in a torque and displacement graph of FIG. 15A, the torsion rod 32 resists twisting and results in a constant resistive torque as the moment arm about the axis of the torsion rod 32 diminishes during rotation towards the base plate 18.

Figure 5:
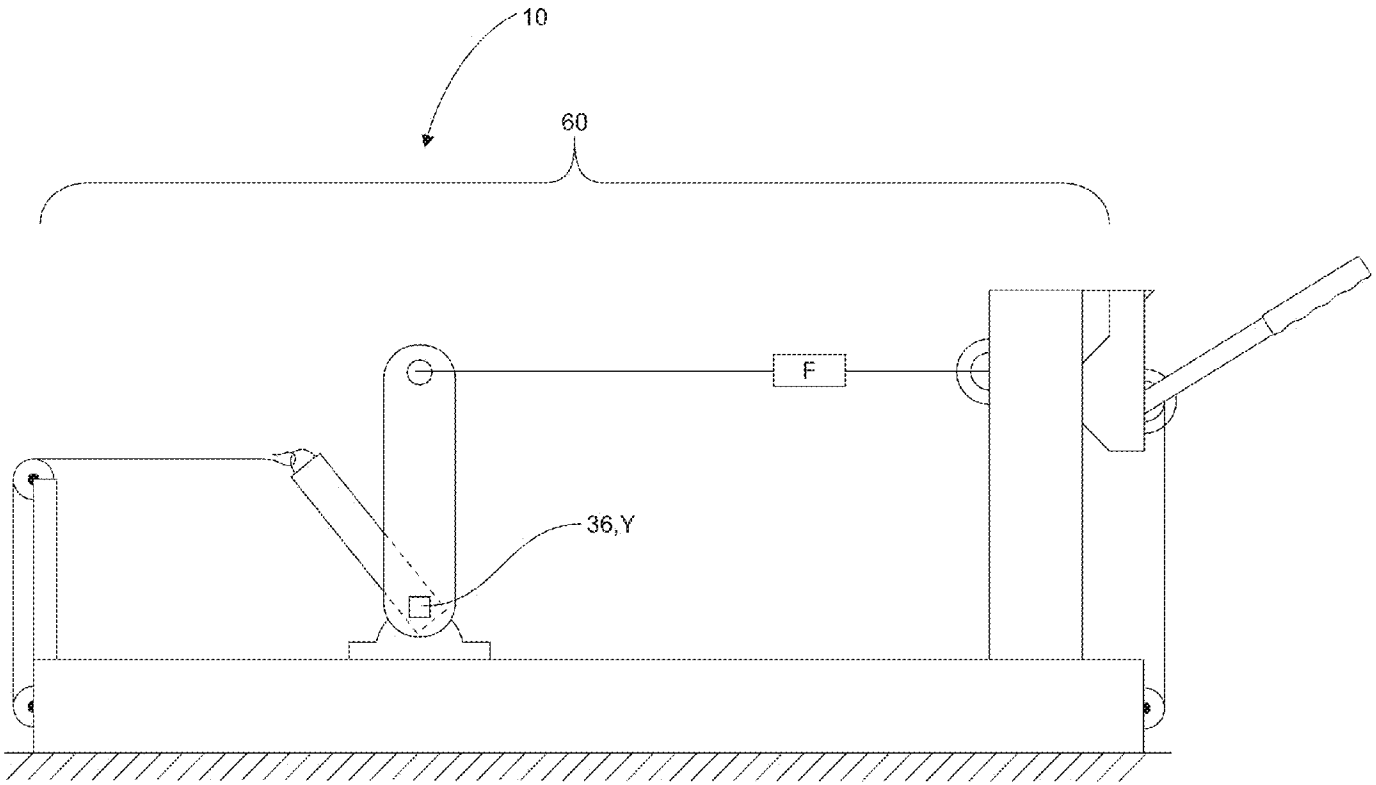
FIG. 5 is a side view testing apparatus illustrating a testing frame representing the base plate, a cable loading arrangement, a post on a torsion rod constant torque device and means for supporting the outboard ends of the torsion rod.

With reference also to FIGS. 1A and 5, the proximal end 16 of the post 12 is fit to the torsion rod 32 and the post extends perpendicular thereto. As an aid to rotational connection therebetween, the torsion rod 32 can have a non-circular cross-section and the post 12 can have a through port or aperture 40 shaped to correspond thereto. Outboard ends 50, 52 of the torsion rod 32 are fit through the pair of spaced supports 34, 34 secured to the base plate 18. The supports 34, 34 have apertures 42, 42 of similar geometry to that of the post's proximal end 16. The supports 34, 34 are spaced apart on opposing lateral sides of the post 12. As stated, the geometries of the apertures 42, 42, 40 may be non-circular so as to aid in preventing relative rotation and thereby resist torsion. Corresponding non-circular apertures may forgo the need for more direct connection, such as by welding, therefore remaining independent and aiding in assembly and replacement of a distorted or spent torsion rod 32. In another embodiment, a circular geometry for the torsion rod 32 and used for the corresponding apertures 40, 42, 42, however requiring direct connection therebetween with the aid of brackets, welding or the like.

The torque resistance of the rod can be designed to achieve various rotational resistance characteristics, and as described above, to impart a generally constant resistive torque at the post 12. The characteristics can be adjusted through design of the rod cross-sectional properties, and support spacing between the rod 32 and outboard ends 34, 34.

The axis Y of rotation is co-aligned through the apertures 42, 40, 42 and the aligned axis of the torsion rod 32 protruding therethrough. The post 12 pivots 36 about the same axis Y as the torsion rod twists, due to the secured fit of the torsion rod 32 within the post 12. The cross-section of the torsion rod 32 may comprise of a variety of geometric shapes such as a square, polygons generally or other non-circular cross-sections. The post 12 may be situate at approximately the midpoint between the supports 34, 34 for even lateral distribution of torsional forces exerted thereon.

In an embodiment, the peripheral fit between apertures 42, 40, 42 and the rod 32 can be a loose so that a spent rod can be readily removed and replaced. One or both supports 34, 34 may be releasably secured to the base plate 18 to aid in replacement and maintenance.

If distortion of the torsion rod interferes with removal, means may be provided to access the torsion rod for forcible removal. For example, a V-shaped access slot 44 may be cut out of the bottom end of the post of a pair of opposing sides adjacent the front and rear sides of the post, transverse to the torsion rod, for access of a cutting tool, such as a saw, to cut a spent torsion rod for removal. As shown in FIGS. 1A and 1B, the first and second ends 50, 52 of the torsion rod 32 may be secured to a base plate 18 by ridged mounting brackets 54, 56 located laterally and equidistant from the post 12.

Figure 3:
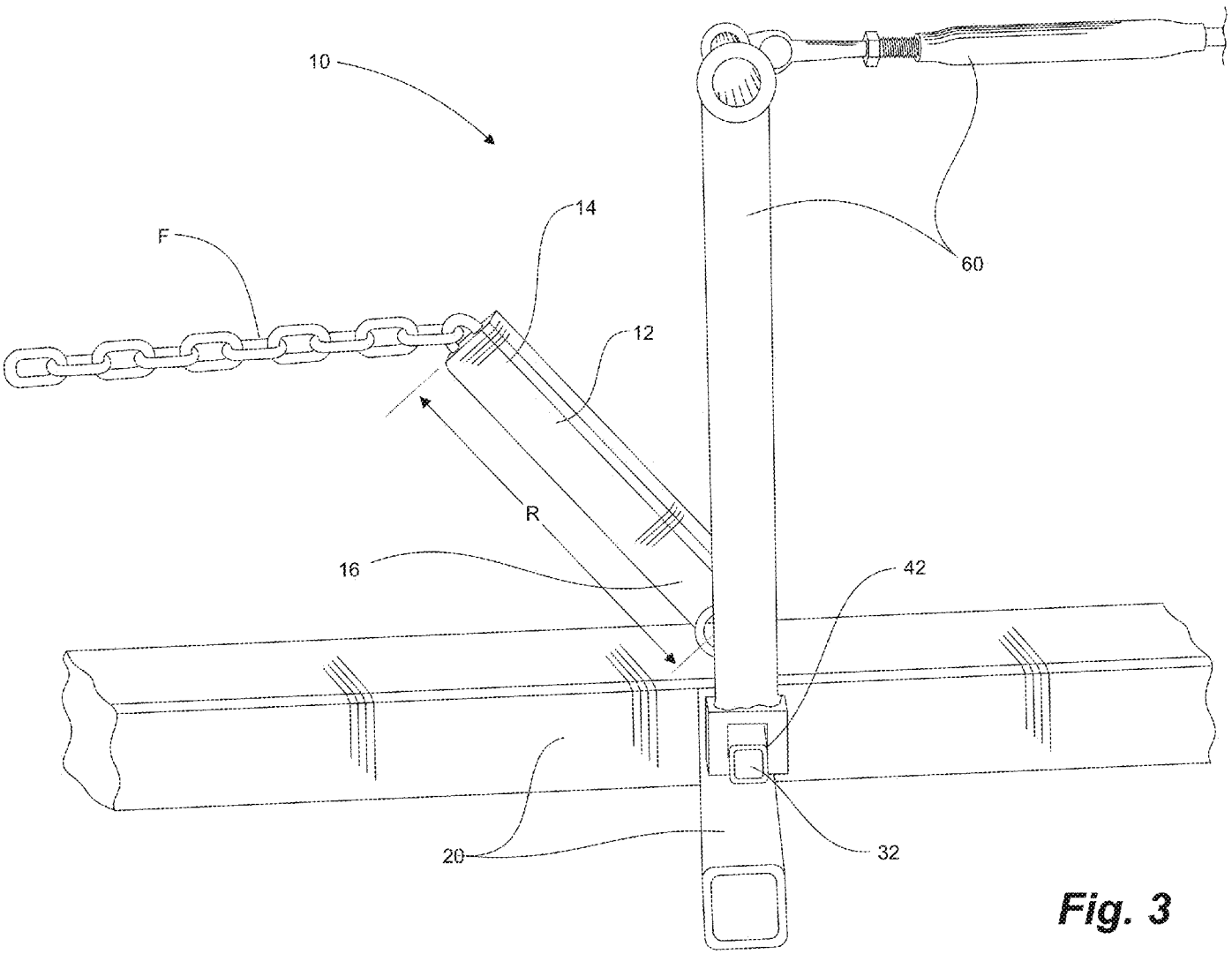
FIG. 3 is a side view of the embodiment of FIG. 1A showing a fall force vector applied to a distal end of a post of a FMA of a test apparatus.
Figure 15B:
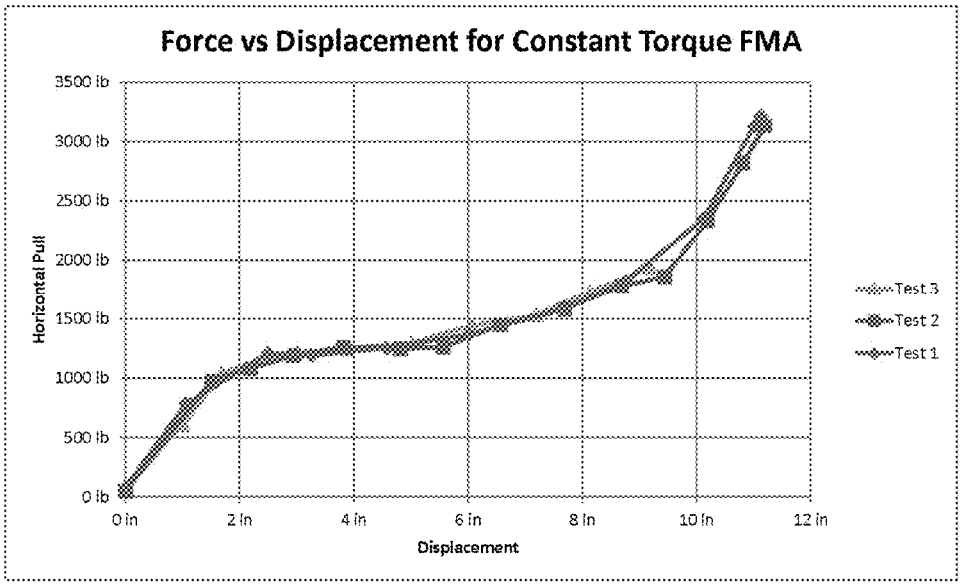

With reference to FIGS. 3,4 and 5, a test apparatus 60 is illustrated from which torque and force curves FIGS. 15A and 15B were generated. FIG. 15B illustrates displacement of the distal end 14 of the post of a test FMA 10 after a force F was applied to the anchor point, pivoting post about its fulcrum 36. As shown, the post was rotated relative to its starting orientation. The torsion rod 32 was shown twisted and plastically deformed along its axis either side of the post, between the post 12 and each outboard support 34, 34. During rotation, a yield zone was found to move along the torsion rod as any particular section became stronger through strain hardening.

As shown in FIGS. 1A and 1B, in an embodiment, stops or gussets 62 may be provided adjacent to the torsion rod 32, and flanking the post 12, for constraining the torsion rod 32 along its axis Y during elastic and plastic deformation. Alternatively, as shown in FIG. 4, one or more bearing supports 64, 64 can be provided adjacent the post 12 to secure the pivot 36 at the proximal end 16 to prevent horizontal bending displacement of the torsion rod 32 in the direction of the pull. Gussets and supports are useful in obtaining test data but may or may not be needed for commercial embodiments of the FMA.

Figure 2A:
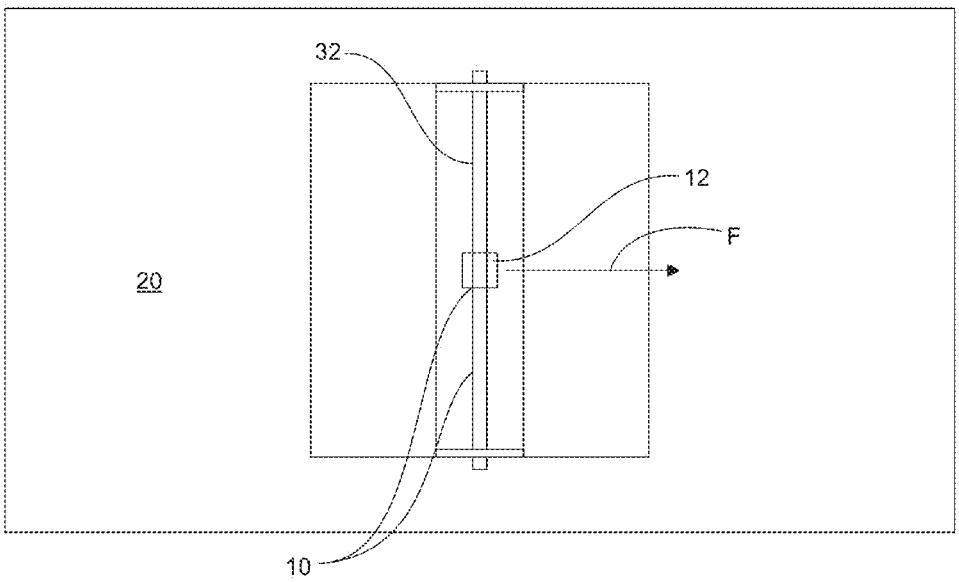
FIG. 2A is a plan view of the FMA of FIG. 1A illustrating an embodiment with the FMA base plate square to the force vector.
Figure 2B:
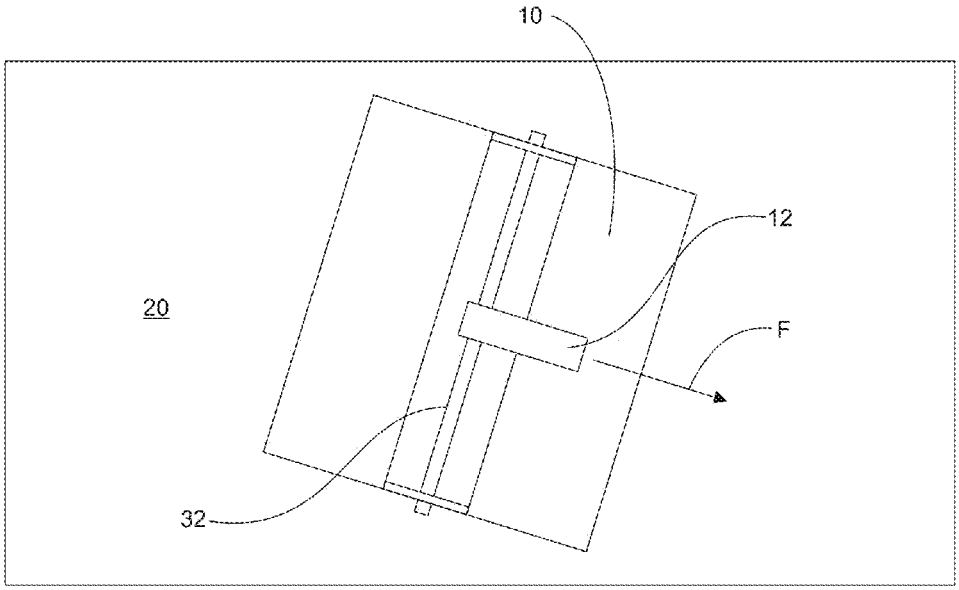
FIG. 2B is a plan view of the FMA of FIG. 1B showing the FMA skewed or rotated with respect to the base plate as adapted to the supporting structure and imposed force vectors.

With reference to FIGS. 2A and 2B, the FMA 10 can be oriented on the base plate 18 at an optimal angle considering the support structure 20 and with respect to the direction of any applied force F. The FMA 10 can be fixed or rotatably positionable on the base plate 18. Workers are generally free to move longitudinally along a lifeline HLL and within a radius of a tether about the FMA. A rotatable base plate 18 reacts and rotes for a worker falling at any angle away from the FMA 10, while maintaining an optimal angular position, allowing torsion of the rod 32 to occur thereby absorbing energy from a fall. Variation in the resulting threshold tear-out torque can be determined for the various orientations and a constant resisting torque at a peak torque applied appropriately. A safety factor can be applied to ensure the peak torque is always below tear-off at any angle.

Tests were performed using the test FMA, the structure of which is shown in FIGS. 3-5. With reference to graph in FIG. 15A, a graphical representation of three sets of experimental data are shown illustrating substantially constant torque achieved throughout the angular rotation and displacement of the FMA post 12 upon the application of a horizontal force F to the attachment loop 24. For the test, the force was gradually applied, the torque climbing until approximately 1100 ft-lbs was applied to the post 12. The torsion rod 32 twisted elastically until the post 12 was approximately displaced about 10 degrees. As more force F was applied, the torsion rod 32 plastically deformed while the effective moment arm, between the distal end 14 and pivot 36, diminished due to the angular displacement of the post, the combination of which resulted in the substantially constant resistive torque between about 1100 and 1200 ft-lbs throughout the angular range of motion. The range of motion was approximately 10 degs to approximately 80 degs.

Similarly, with reference to FIG. 15B, a horizontal force F was applied, climbing to approximately 1000 lbs, while the post's distal end 14 was displaced by approximately 2 in. The resisting force then increased, slowly at first, and more rapidly as the angle of rotation increased and the moment arm diminished in proportion to 1/cos(angle). The post 12 did not reach a completely horizontal orientation, however, the post 12 rotated to an angle that resisted the force vector F applied thereto. Due to the resistive force increasing as the post rotates, the constant torque design absorbed approximately 40% more energy up to an 80 degree rotation than designs that horizontally deploy at a constant force over the same distance.

Example #2

Friction Clutch

Figure 6:
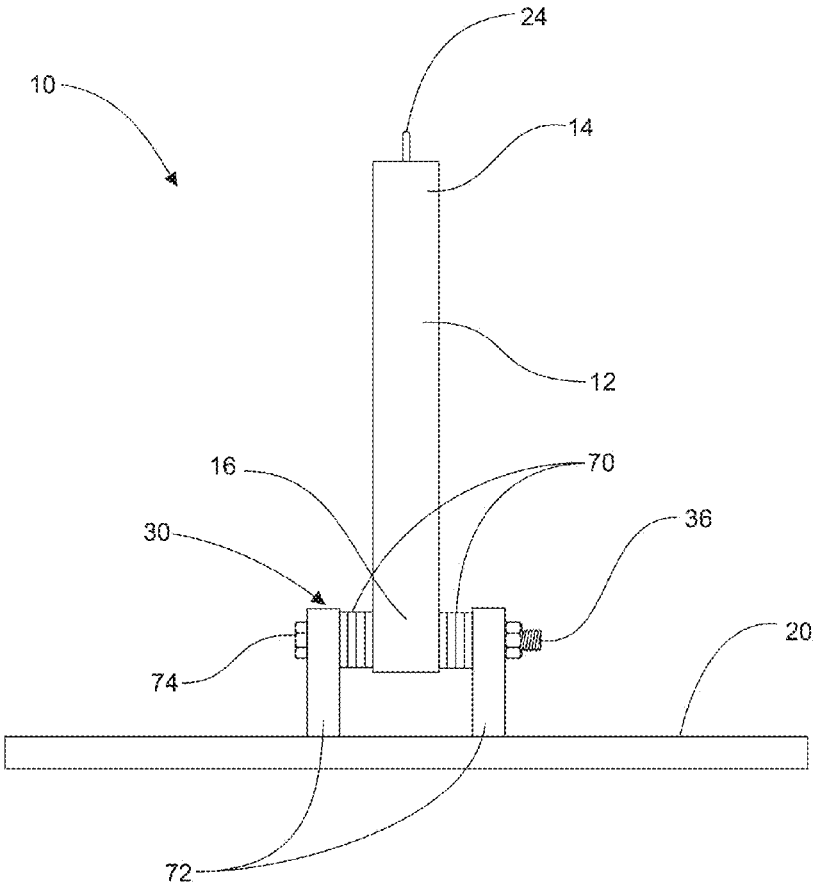
FIG. 6 is an end view of an embodiment of a constant torque FMA utilizing a friction clutch design of the constant torque device.

With reference to FIG. 6, and in another embodiment, a clutch-type of constant torque device 30 is provided. The post 12 is sandwiched between clutch plates 70, 70, 70 . . . and mounting brackets 72, 72 fit to the base plate 12. The post 12 is rotatable about a pivot 36. Such clutches can be drawn from known devices. The mounting brackets 72, 72 straddle the laterally opposing sides of the post 12. A bolt 74 extends therethrough along the pivot 36, connecting the post 12 to the base plate 18. The post 12 pivots about the bolt 74 when a force F is applied to the attachment loop 24 thus creating a torque about the bolt 74. The clutch plates 70 impart a high coefficient of friction between the post 12 and the mounting brackets 72, 72, such as through a plurality of lubricated washers, for creating resistance to the torque created about the bolt 74. The amount of resistance may be modified by tightening the bolt 74 thus increasing the torsional frictional resistance between the post 12, plates 70 and mounting brackets 72, 72. As a result, the clutch provides a constant resistive torque as the post rotates thereabout, and provides means for a skilled installer to adjust the torque to match the torsional capacity of the surface 2, optimizing the energy absorption to the full capacity of the underlying structure.

Thus, one can apply a substantially constant resisting torque against the fall force vector by resisting rotation of the post at the friction clutch acting between the proximal end of the post and the base plate.

Example #3

Circular Cam

Figure 7B:
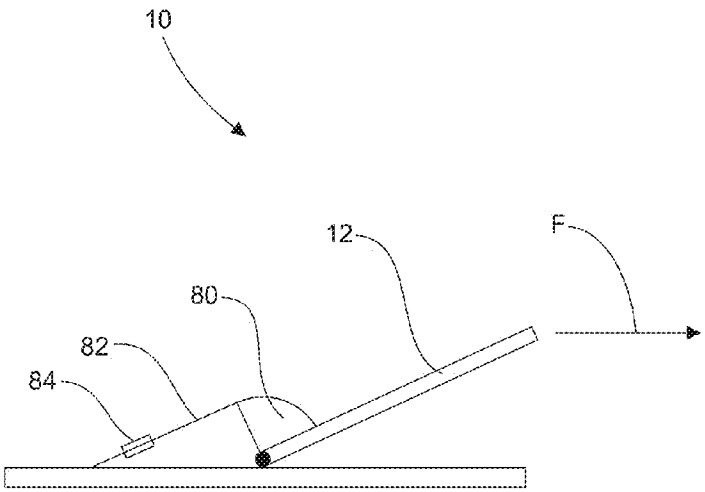
FIG. 7B is a side view of the FMA of FIG. 7A illustrating a second position.
Figure 7A:
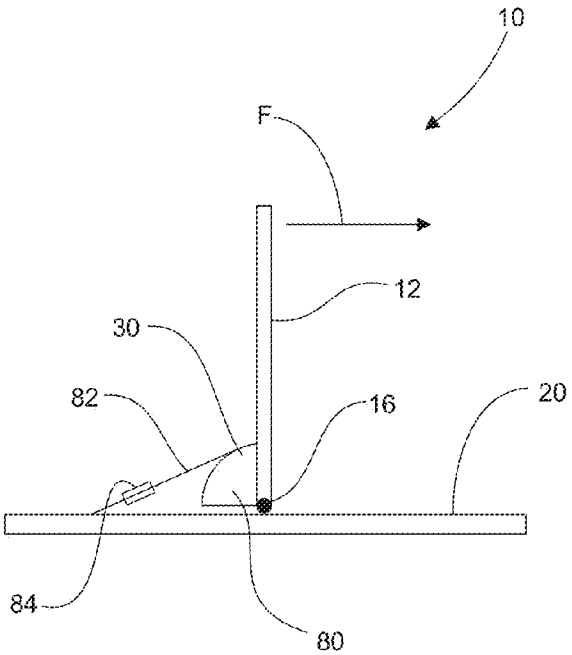
FIG. 7A is a side view of an embodiment of a constant torque FMA utilizing a circular cam design in a first position.

With reference to FIGS. 7A and 7B and in another embodiment, a circular cam type of constant torque device 30 is provided. In this embodiment, an arcuate shaped cam 80 is attached to the side of the post 12 and extends rearwardly, opposite the direction of the force vector F. A flexible tensile member, such as a cable 82, connects between the post 12 and a constant force energy absorber 84. The cable 82 extends from the energy absorber 84, over the cam 80 and to a connection intermediate along the post 12. As the post rotates, the cable 82 extends from the energy absorber 84 and the 80 cam maintains a lever arm sufficient to ensure the resistive force from the energy absorber 84 is imparts a constant resistive torque to oppose the angular motion of the post 12. The constant force energy absorber 84, such as those that may be currently used in energy absorbing lanyards, is connected to the base plate 18 in alignment with the pivoting path of the post 12.

As the force increases the constant force energy absorber 84 exerts a constant resistive load on the post 12 at a constant lever distance as the post tips angularly downward with an ever diminishing moment arm. As a result, the mechanism provides a constant resistive torque as the post rotates thereabout.

Thus, a substantially constant torque resists the fall force vector by directing the cable over a cam rotatable with the post and resisting extension of the cable from the constant force energy absorber, the cam adjusting the lever arm to result in a constant resisting torque.

Example #4

Variable Cross-Section

Figure 9B:
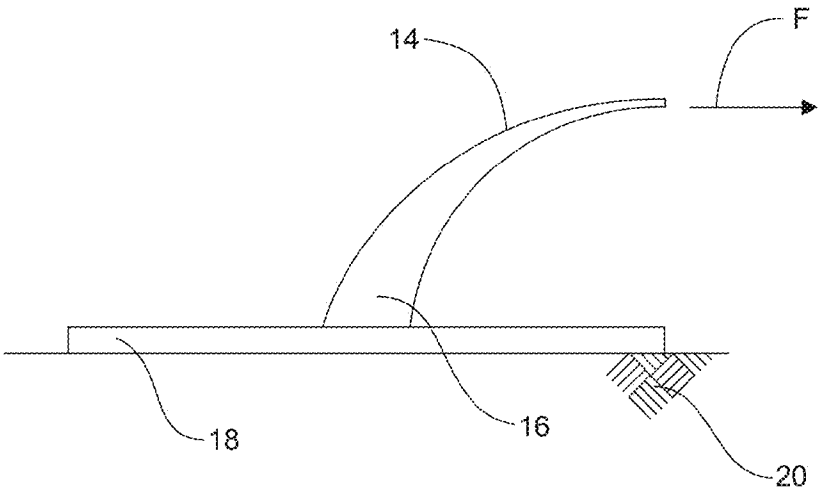
FIG. 9B is a side view of the post of FIG. 9A in a second fall arrest position.
Figure 9A:
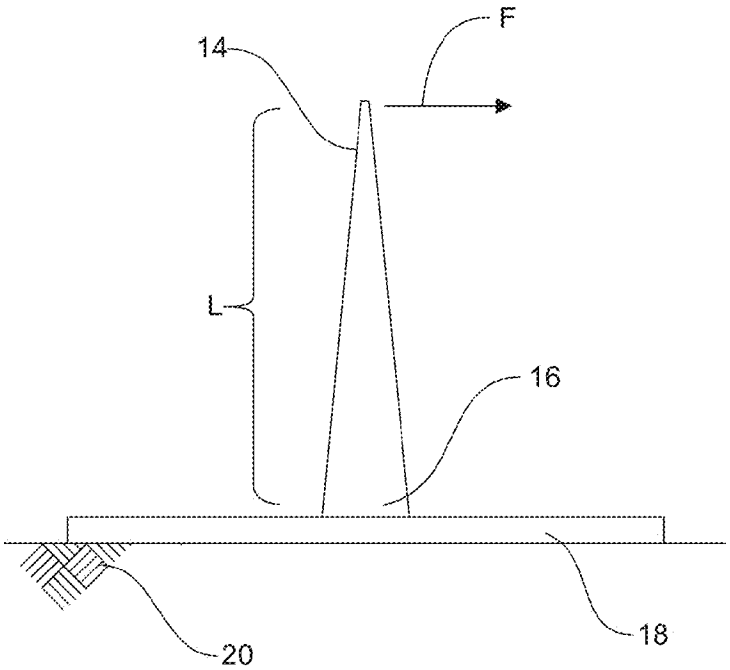
FIG. 9A is a side view of an embodiment of a FMA illustrating a post with a tapered cross-sectional post in a first position.
Figure 10B:
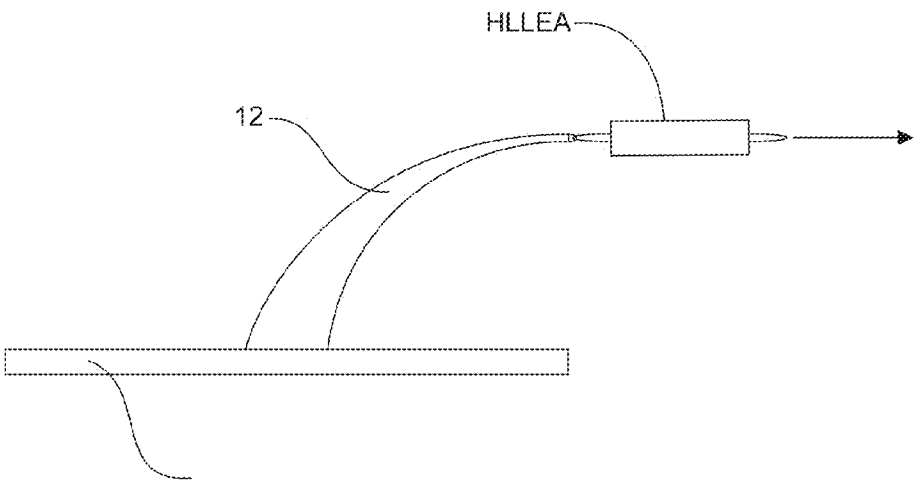
FIG. 10B is a side view of the FMA of FIG. 10A illustrating the post in a second fall arrest position.
Figure 10A:
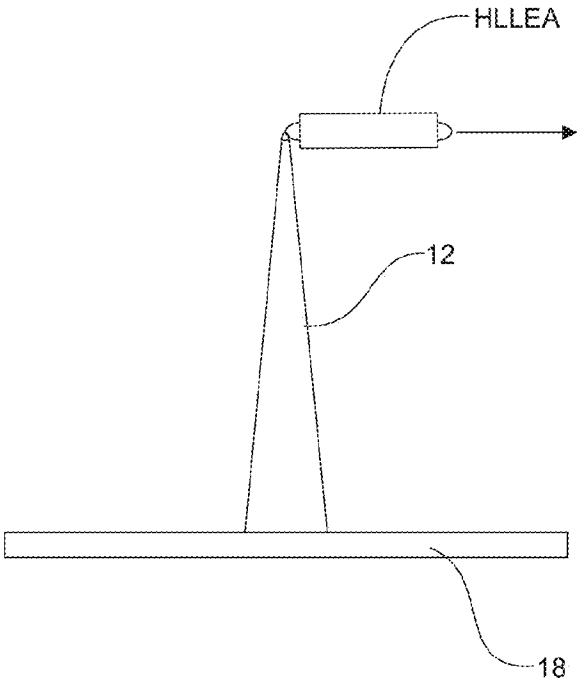
FIG. 10A is a side view of the FMA of FIG. 9A further including a horizontal lifeline energy absorber connected thereon in a first position prior to a fall.

With reference to FIGS. 9A and 9B, and in another embodiment, the upright post comprises a cross-section that varies, along at least a portion of the length L or radius R of the post 12 from its distal end 14 towards the proximal end 16, for maintaining a substantially constant torque as it bends when the fall force vector F is applied. The post 12 can have any cross-sectional geometric shape and may be solid or hollow.

Applicant understands that a yield zone is formed in the post starting at extreme fibres of the post cross-section and then transitions towards more of the cross-section in yield. The bending moment increases from the point where yield is first reached at the extreme fibres to the point where practically the entire cross-section is yielding, one half in compression and one half in tension on either side of the post's neutral axis. For example, in a post manufactured of a solid diameter rod, a ratio of the fully plastic moment to the starting moment, where the post first starts to yield, is about 1.7. For simplicity of this illustration and related illustrations, the effect of strain hardening are not included in the ratios. Thus a solid rod post of constant cross-section therealong will mostly hinge at the proximal end at the base plate and would have a resistive torque that varies and increases by up to or exceeding 1.7 as it bends over.

Therefore, in order to obtain a constant torque as the post bends over, as shown in FIG. 9B, the cross-section is tapered, counteracting this effect. Thus, upon application of the fall force vector F, the bending zone is caused to move to other sections of the post 12 that are weakened, keeping the torque constant.

Various different cross-sections can assist in reducing the ratio of the fully plastic moment to the yield moment. For example, a hollow pipe or tubular post has a better and lower ratio, a ratio of 1.4 being achievable. For an I-section, a ratio of 1.1 is achievable. Therefore, the rise in torque in an I-section post is only 10%, instead of 70% for an untapered solid rod. Simply, the purpose of the taper is to make the bending hinge point move along the length of the post as strain hardening and yielding transitions from extreme fibres to more of the cross-section increases the moments. In theory, having designed the cross-section and taper, one could theoretically force the entire height of the post to hinge at the same time instead of a localized hinge although, due to localized variations in metallurgy, the hinging will likely move up and down the post.

Thus the taper mitigates any increases in torque to achieve a constant torque, the resulting mitigation being about 10% for the I-section post, about 70% for a solid rod and about 40% for an untapered hollow pipe, as a smaller proportion of the tapered cross-section goes into yield. Every cross-section of a tapered post has a zone near the outer fibre that is fully plastic and the rest of the cross-section will remain in an elastic state, reducing the ratio of the initial yield moment to the moment attained in the post to less than 1.1 and approaching about 1.

Figure 11B:
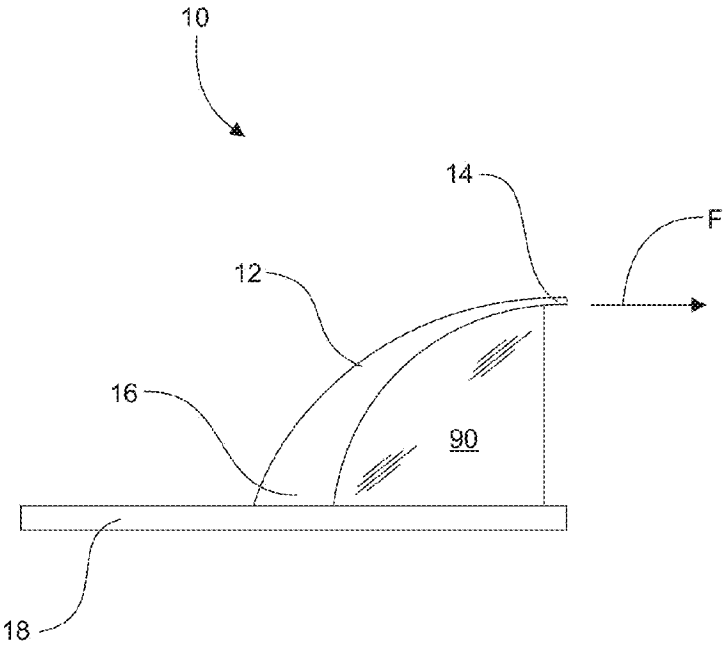
FIG. 11B is a side view of the FMA of FIG. 11A illustrating the tapered post bent over the post guide structure in a second fall arrest position.
Figure 11A:
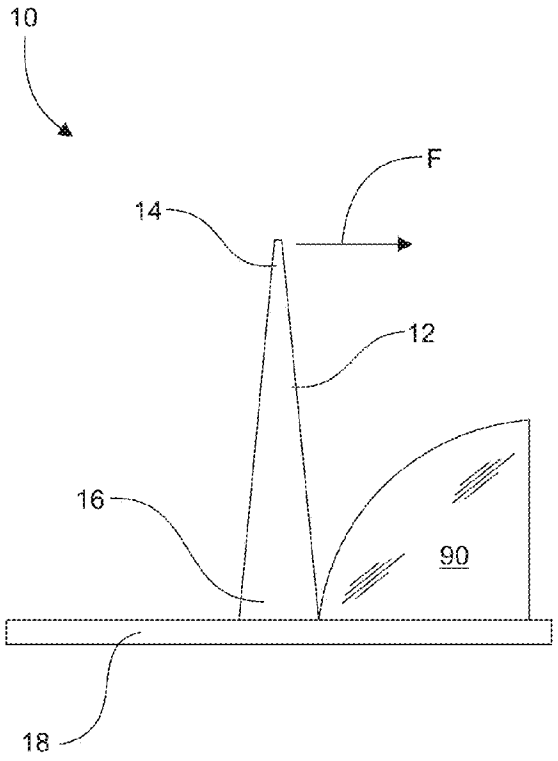
FIG. 11A is a side view of the post of FIG. 11A with a tapered post and post guide structure in a first position.
Figure 12B:
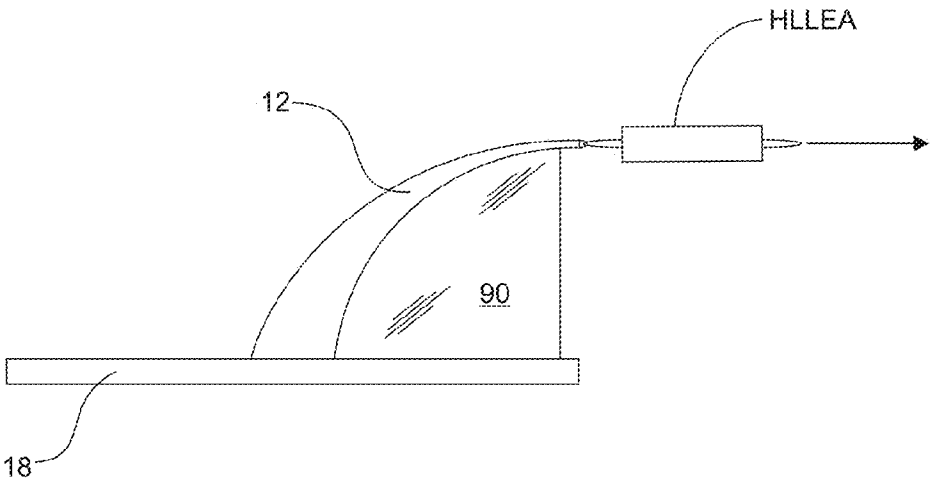
FIG. 12B is a side view of the FMA of FIG. 12B in a second fall arrest position.
Figure 12A:
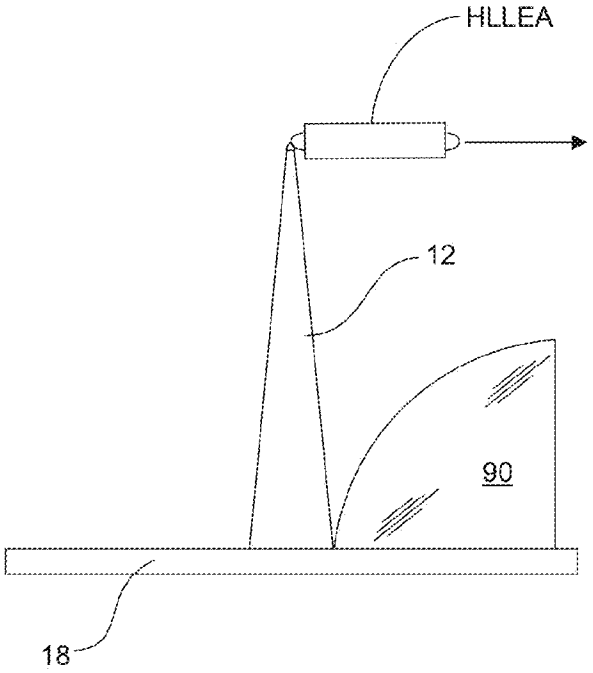
FIG. 12A is a side view of the FMA of FIG. 11A further including a horizontal lifeline energy absorber connected thereon in a first position.
Figure 13A:
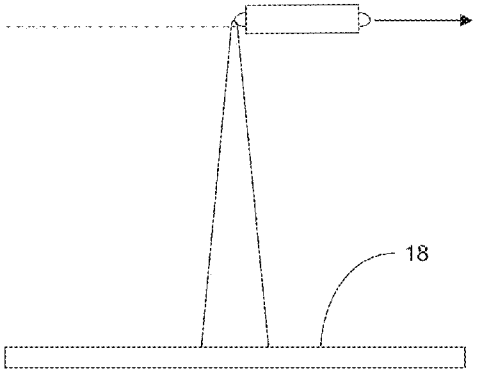
FIGS. 13A to 13D are sequential views a horizontal lifeline energy absorber connected to a tapered post as the moment arm diminishes during post displacement.
Figure 13B:
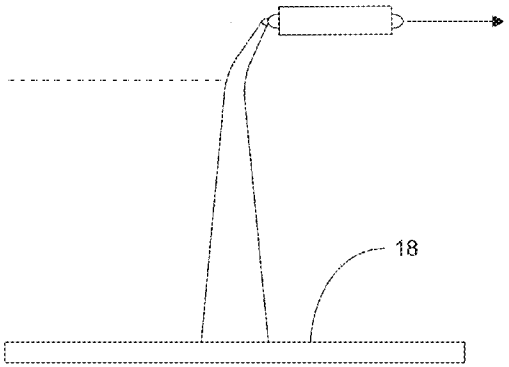
Figure 13C:
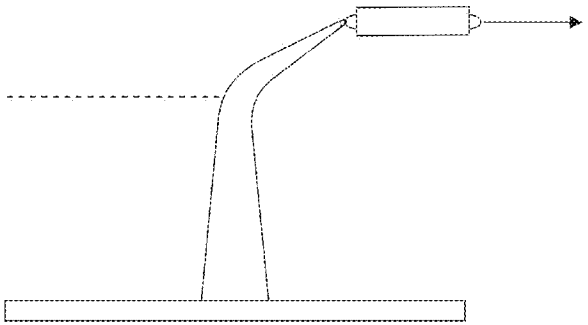
Figure 13D:
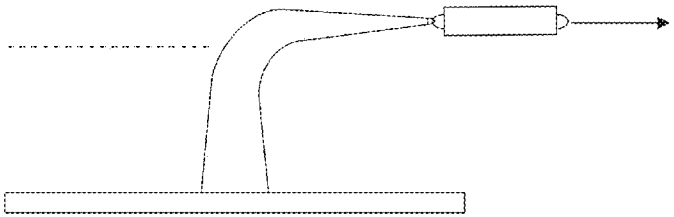

With reference to FIGS. 11A and 11B, and in another embodiment, a post guide 90 is provided adjacent the force-side of FMA's 10 having a post 12 of variable cross-section. The post guide 90 is an arcuate configuration, like a cam, for guiding the post 12 in a controlled manner as it deforms. Further, this embodiment may also be used alter the response of a post of constant cross-section to achieve a desired constant torque similar to that of the cam embodiment of FIGS. 7A and 7B.

With reference to FIGS. 10A, 10B and 12A, 12B, in further embodiments, a horizontal lifeline energy absorber (HLLEA) can be provided to work in conjunction with various embodiments disclosed herein, and in particular, to the posts 12 of variable cross-section. The post guide embodiment lacks the range of motion as previously described in Examples 1, 2, and 3 above. As a result, the torque may increase somewhat once the design deployment range is exceeded. The HLLEA deploys at the maximum intended horizontal force F, once the post 12 is fully deployed, to maintain the desired constant torque applied to the base, and thus aid in ensuring that the FMA 10 does not disengage from the roof surface 20 due to the resultant torque.

Example #5

Non-Perpendicular Starting Orientation

Figure 8B:
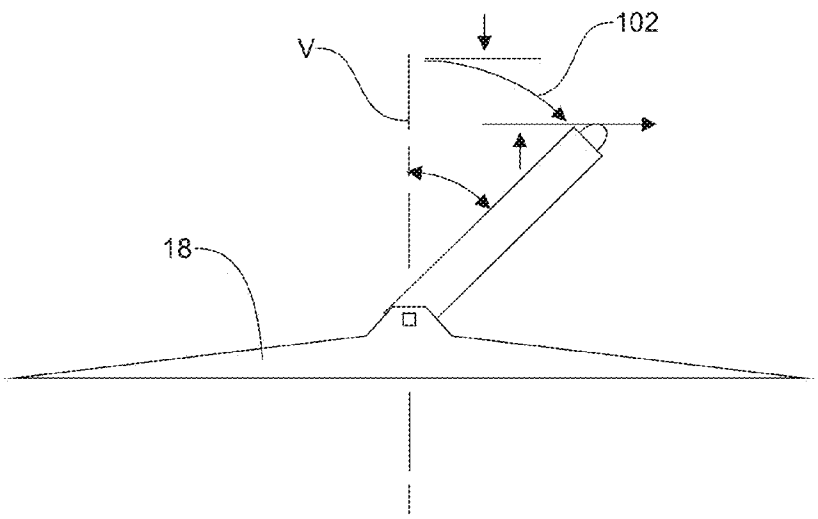
FIG. 8B is a side view of the extended range FMA of FIG. 8A after a fall arrest force has been applied.
Figure 8A:
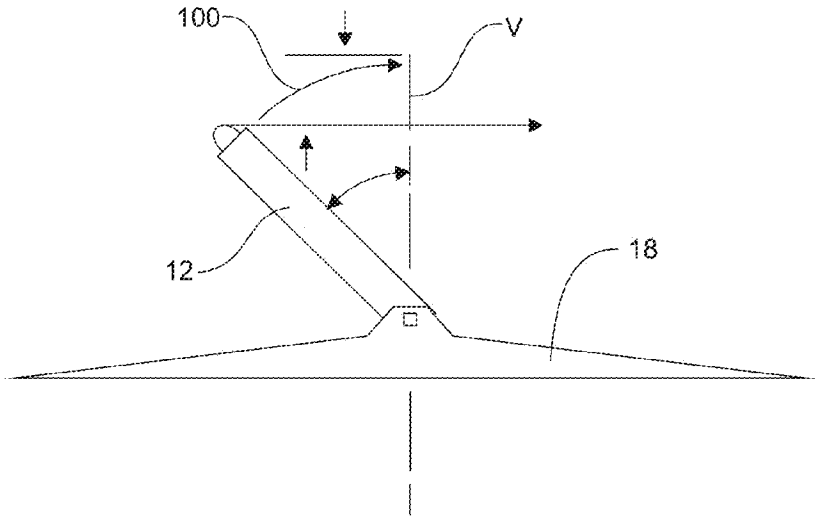
FIG. 8A is a side view of an embodiment of an enhanced, extended range energy-absorption FMA illustrating a post initially angularly offset rearwardly in a first position from a perpendicular plane of the base plate, the post tilting away from the expected application of the force vector.

With reference to FIGS. 8A and 8B, in another embodiment, the post may be initially oriented in a first position, at an angle leaning away from the pending applied force or towards the fall force vector. As shown in the embodiment of FIG. 8A, one can initially orient the post's distal end 14, rearward of perpendicular V to the base plate 18. As a result of the post 12 leaning away from the fall force vector F, the range of the angular rotation of the post 12 is significantly increased, thus absorbing more energy than a configuration with less angular rotation. The moment arm of the upright post 12 initially increases 100 as it rotates to a perpendicular upright position V, over-centers and then diminishes 102 towards the tipped position.

Figure 14B:
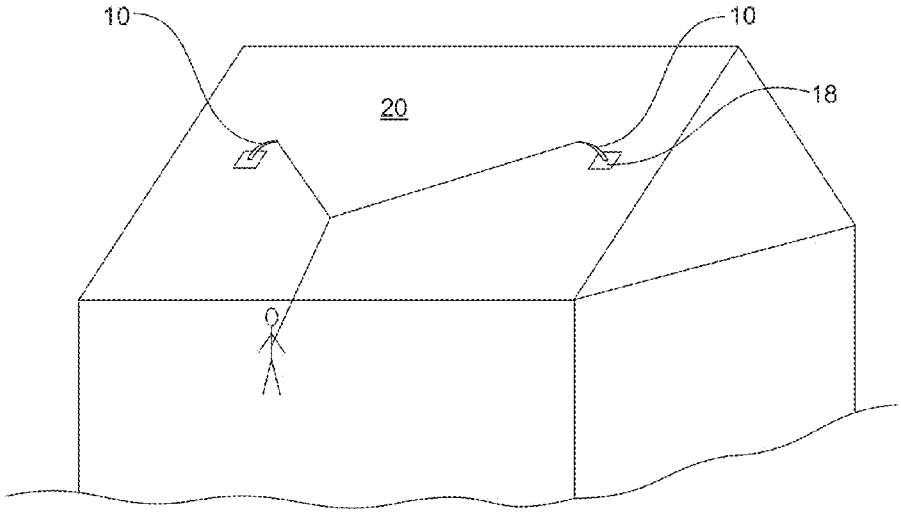

In either embodiment of FIGS. 8A and 8B, leaning away or towards the fall force vector, as the moment arm is initially shorter, a greater horizontal force is required to initiate the rotation of the post 12. This can be important for travel restraint systems where the applied forces from a worker stumbling towards an edge often cause these devices to deploy, causing the HLL to sag enough to let the worker reach and needlessly fall off the edge (FIG. 14B). This embodiment allows the device to anchor a travel restraint system while still having sufficient energy absorbing capability for fall arrest. A travel restraint system is not intended to deploy the FMA 10 because this would then cause the HLL to sag and the worker to fall off the roof surfaced 20, no longer acting as a travel restraint per se.

In FIG. 8A, a greater angular rotation of the post 12 translates into a greater linear distance a worker will experience in a fall situation, however the energy absorbed in the constant torque, throughout the greater angular rotation, offsets the energy generated by this greater linear distance.

The increase angular range embodiment may be used in conjunction with any of the other constant torque embodiments described herein.

The embodiments of the invention for which an exclusive property or privilege is claimed are defined as follows:

1. A fall management anchor secured to a surface, a fall force vector being applied thereto, comprising:

a base plate secured to the surface and having a threshold tear-off torque;

a generally upstanding cantilever post having a post height, a proximal end connected to the base plate and having a distal end forming a moment arm to the base plate, wherein the fall force vector applied adjacent the distal end and multiplied by the post height applies a moment equal to or greater than the threshold tear-off torque, the fall force vector oriented generally parallel to the base plate, the distal end being actuable upon application of the fall force vector to move relative to the base plate between a maximum moment arm and a minimum moment arm in response to the fall force vector; and a constant torque apparatus operative between the distal end and the base plate for applying an increasing resistive force to the post, the resistive force at the maximum moment arm forming a resistive torque being less than or equal to the threshold tear-off torque, the resistive torque remaining generally constant at the base plate as the post's moment arm diminishes from the maximum to the minimum.

2. The fall management anchor of claim 1, wherein upon first application of the fall force vector, the distal end of the post presents a minimum resistive force at the maximum moment arm for generating a peak resistive torque at or less than the threshold tear-off torque.

3. The fall management anchor of claim 2, wherein the distal end of the post presents a maximum resistive force at the minimum moment arm.

4. The fall management anchor of claim 1, wherein:

the post is rigid; and the constant torque apparatus is situate between the connection of the proximal end of the post and the base plate.

5. The fall management anchor of claim 4, wherein the constant torque apparatus is a friction clutch.

6. The fall management anchor of claim 4, wherein the constant torque apparatus further comprises:

a torsion rod, the torsion rod is rotationally constrained at outboard ends to the base plate; and the proximal end of the post is rotationally constrained to the torsion rod at a point intermediate the outboard ends, wherein upon actuation of the post's distal end, the torsion rod twists between the outboard supports and the post's distal end moves, the torsion rod generating the generally constant torque at about the peak resistive torque.

7. The fall management anchor of claim 1, wherein:

the connection of the proximal end of the post to the base plate is fixed, the cross-section of the post varies along its length from a minimum cross-section at the distal end to a maximal cross-section at the proximal end wherein the post yields successively along its length as the distal end moves and as the fall force vector is applied at a successively diminishing moment arm for generating the generally constant torque at about the peak resistive torque.

8. The fall management anchor of claim 1, wherein:

the yield zone moves from substantially adjacent the proximal end towards the distal end.

9. The fall management anchor of claim 1, wherein the post is pivotally connected to the base plate, the constant torque apparatus further comprises:

a constant force energy absorber having a cable extending between the post and the base plate;

a generally circular cam intermediate the post and the energy absorber, the cable extending over the cam, wherein as the rotates about the base plate, the cable exerts a generally constant resistive force on the post at a generally constant moment arm for generating the generally constant torque at about the peak resistive torque.

10. The fall management anchor of claim 4, wherein the constant torque apparatus resists rotation of the distal end of the post when the fall force vector is applied thereto for absorbing energy generated due to rotation of the distal end.

11. The fall management anchor of claim 1, wherein the generally upstanding cantilever post is oriented rearward of perpendicular to the base plate.

* * * * *